US010807118B2

(12) United States Patent
Matsumoto

(10) Patent No.: US 10,807,118 B2
(45) Date of Patent: Oct. 20, 2020

(54) SEALANT DISCHARGING APPARATUS

(71) Applicant: SUBARU CORPORATION, Tokyo (JP)

(72) Inventor: Yohei Matsumoto, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 0 days.

(21) Appl. No.: 16/589,315

(22) Filed: Oct. 1, 2019

(65) Prior Publication Data

US 2020/0114391 A1 Apr. 16, 2020

(30) Foreign Application Priority Data

Oct. 11, 2018 (JP) ..... 2018-192786

(51) Int. Cl.
*B05C 17/005* (2006.01)

(52) U.S. Cl.
CPC .. *B05C 17/00516* (2013.01); *B05C 17/00506* (2013.01)

(58) Field of Classification Search
CPC ..... B05B 17/00516; B05B 17/00506
See application file for complete search history.

(56) References Cited

U.S. PATENT DOCUMENTS 5,074,443 A * 12/1991 Fujii ..... B05C 5/0225 118/684
2001/0020629 A1* 9/2001 Fujii ..... B05C 5/0225 222/504
2006/0139562 A1 6/2006 Lee et al.
2009/0206112 A1* 8/2009 Fort ..... B05C 5/001 222/504
2016/0023233 A1* 1/2016 Hayashi ..... B05C 5/0225 222/544

FOREIGN PATENT DOCUMENTS

JP 2006-187753 A 7/2006

* cited by examiner

*Primary Examiner* — Jeremy Carroll
(74) *Attorney, Agent, or Firm* — Troutman Pepper Hamilton Sanders LLP

(57) ABSTRACT

A sealant discharging apparatus includes a cartridge, a nozzle member, and a cartridge receiver. The cartridge includes a projection member at a tip end and stores sealant therein. The projection member has a thread groove internally. The nozzle member includes a terminal end insertable in the projection member. The cartridge receiver includes a first tapered member in which the projection member is insertable. The first tapered member has a gradually decreasing inner diameter in a tip end direction in which the projection member is insertable.

7 Claims, 6 Drawing Sheets

28
21
31
30
5
24
23
24a
24b
26a
26
27

SEALANT DISCHARGING APPARATUS

CROSS-REFERENCE TO RELATED APPLICATIONS

The present application claims priority from Japanese Patent Application No. 2018-192786 filed on Oct. 11, 2018, the entire contents of which are hereby incorporated by reference.

BACKGROUND

The disclosure relates to a sealant discharging apparatus.

A sealant discharging apparatus applies sealant stored in a cartridge to an object (see Japanese Unexamined Patent Application Publication No. 2006-187753). When the sealant stored in the cartridge is used up in the sealant discharging apparatus, the cartridge is replaced with a new one.

SUMMARY

An aspect of the disclosure provides a sealant discharging apparatus including a cartridge, a nozzle member, and a cartridge receiver. The cartridge includes a projection member at a tip end and stores sealant therein. The projection member has a thread groove internally. The nozzle member includes a terminal end insertable in the projection member. The cartridge receiver includes a first tapered member in which the projection member is insertable. The first tapered member has a gradually decreasing inner diameter in a tip end direction in which the projection member is insertable.

BRIEF DESCRIPTION OF THE DRAWINGS

The accompanying drawings are included to provide a further understanding of the disclosure and are incorporated in and constitute a part of this specification. The drawings illustrate example embodiments and, together with the specification, serve to explain the principles of the disclosure.

DETAILED DESCRIPTION

Figure 1:
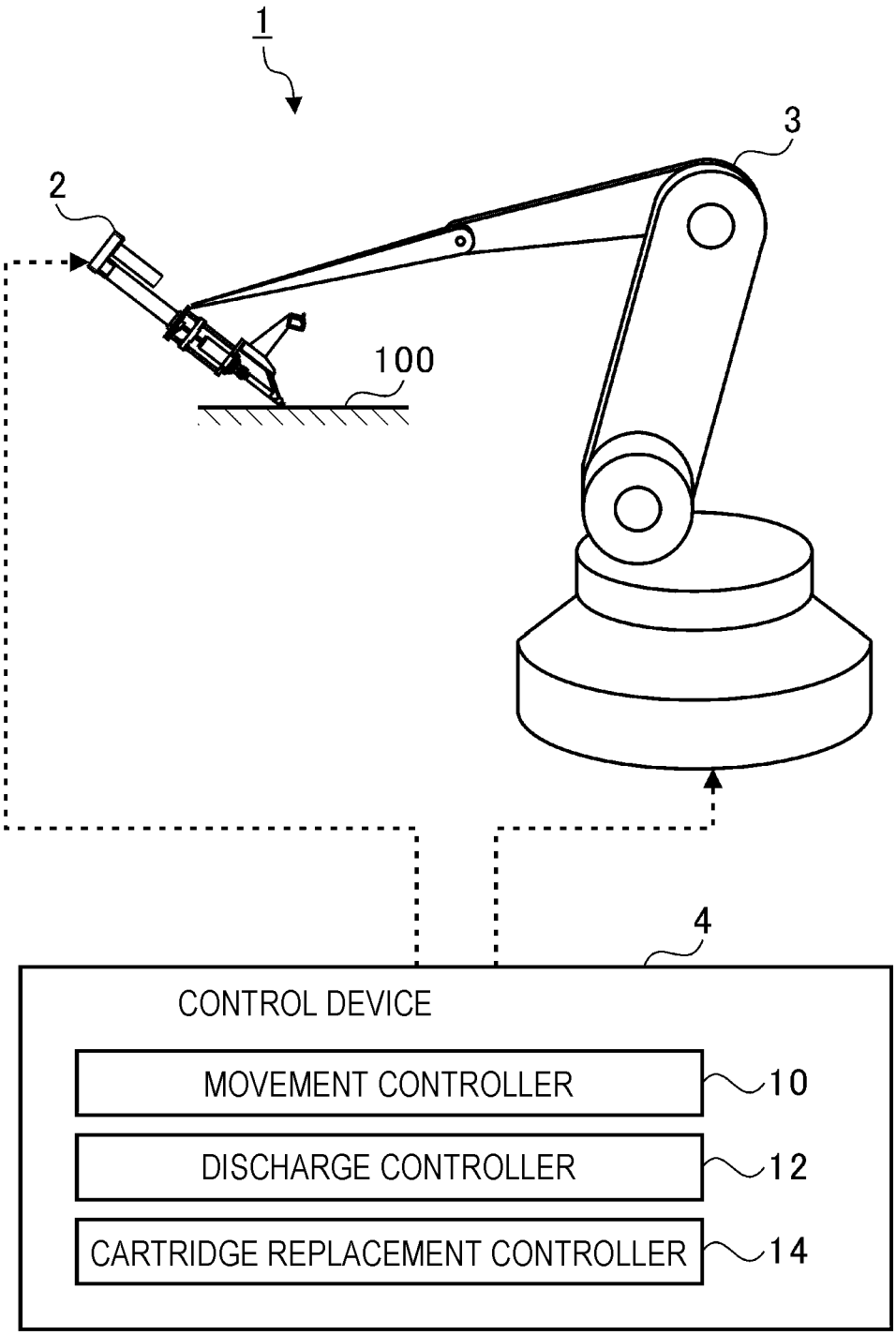
FIG. 1 is a diagram illustrating the configuration of a sealant discharging apparatus.

In the following, a preferred but non-limiting embodiment of the disclosure is described in detail with reference to the accompanying drawings. Note that sizes, materials, specific values, and any other factors illustrated in the embodiment are illustrative for easier understanding of the disclosure, and are not intended to limit the scope of the disclosure unless otherwise specifically stated. Further, elements in the following example embodiment which are not recited in a most-generic independent claim of the disclosure are optional and may be provided on an as-needed basis. Throughout the present specification and the drawings, elements having substantially the same function and configuration are denoted with the same reference numerals to avoid any redundant description. Further, elements that are not directly related to the disclosure are unillustrated in the drawings. The drawings are schematic and are not intended to be drawn to scale. A replaceable cartridge has a thread groove at its tip end. When the cartridge is replaced, a user screws the cartridge into a nozzle or a nozzle adapter of the sealant discharging apparatus. Thus, it takes time and effort to replace the cartridge.

It is desirable to provide a sealant discharging apparatus that allows easy replacement of a cartridge.

FIG. 1 is a diagram illustrating the configuration of a sealant discharging apparatus 1. It is to be noted that the flow of a signal is indicated by a dashed arrow in FIG. 1.

As illustrated in FIG. 1, the sealant discharging apparatus 1 includes a sealing gun 2, a robot arm 3, and a control device 4. The sealing gun 2 discharges and applies sealant to an object 100 based on the control of the control device 4. The configuration of the sealing gun 2 will be described in detail later.

The robot arm 3 has multiple joints, and the sealing gun 2 is fixed to the tip end of the robot arm 3. In the robot arm 3, the joints are each provided with an actuator. The robot arm 3 drives each actuator based on the control of the control device 4, thereby moving the sealing gun 2 at any position and velocity.

The control device 4 is implemented by a microcomputer including a central processing unit (CPU), a ROM which stores programs and the like, and a RAM serving as a work area. The control device 4 loads the programs stored in the ROM to the RAM, and executes the programs, thereby serving as a movement controller 10, a discharge controller 12, and a cartridge replacement controller 14.

The movement controller 10 performs drive control on the actuator provided in each joint of the robot arm 3. Thereby, the robot arm 3 can move the sealing gun 2 at any position and velocity The discharge controller 12 controls the discharge amount of the sealant which is discharged from the sealing gun 2 to the object 100.

When replacing a cartridge 24 (see FIG. 2) of the sealing gun 2, the cartridge replacement controller 14 controls driving of the sealing gun 2, the robot arm 3, and a robot hand 5 (see FIGS. 5A to 5C, FIGS. 6A to 6D).

Figure 2:
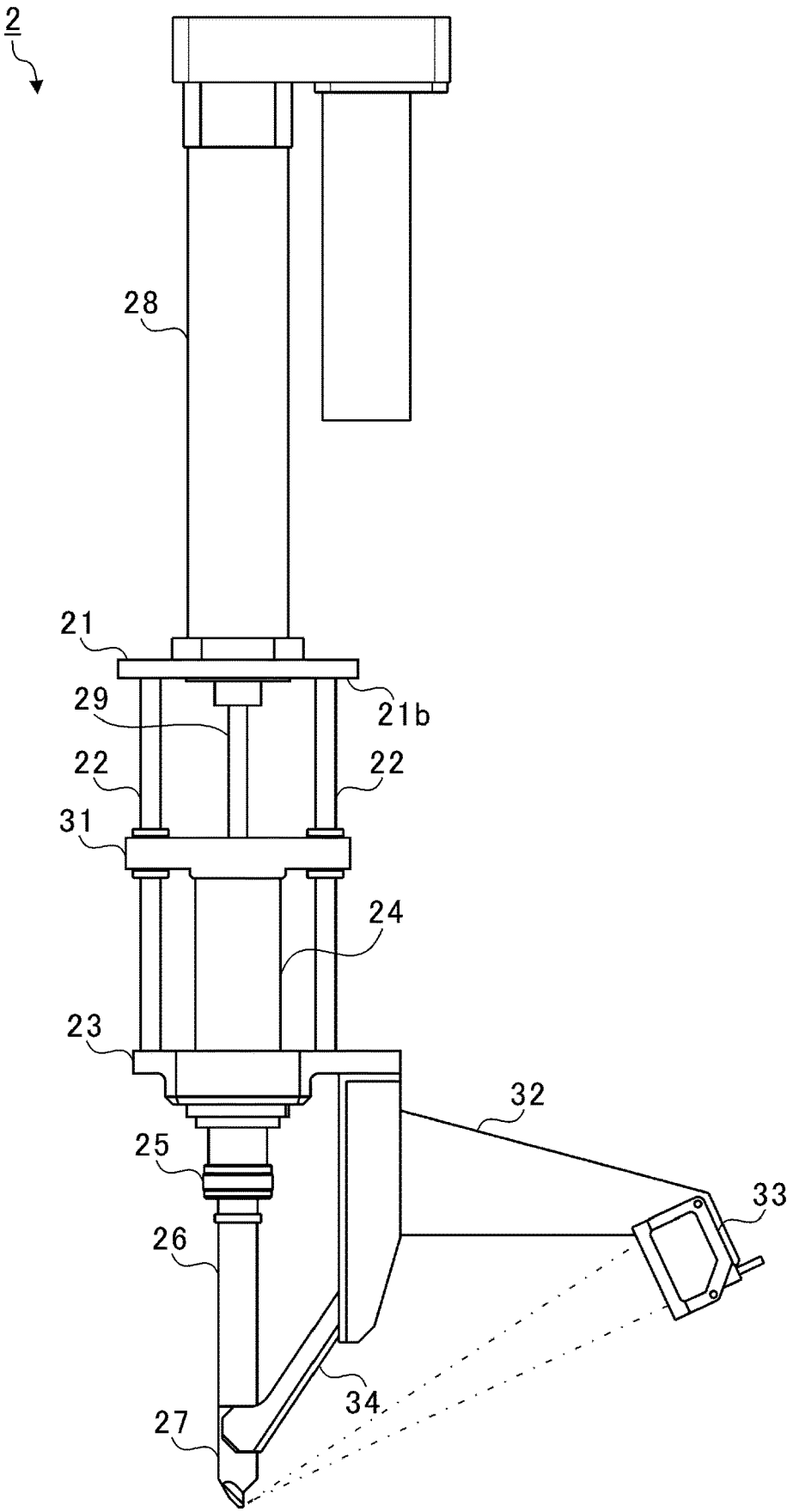
FIG. 2 is a view illustrating the configuration of a sealing gun.
Figure 3:
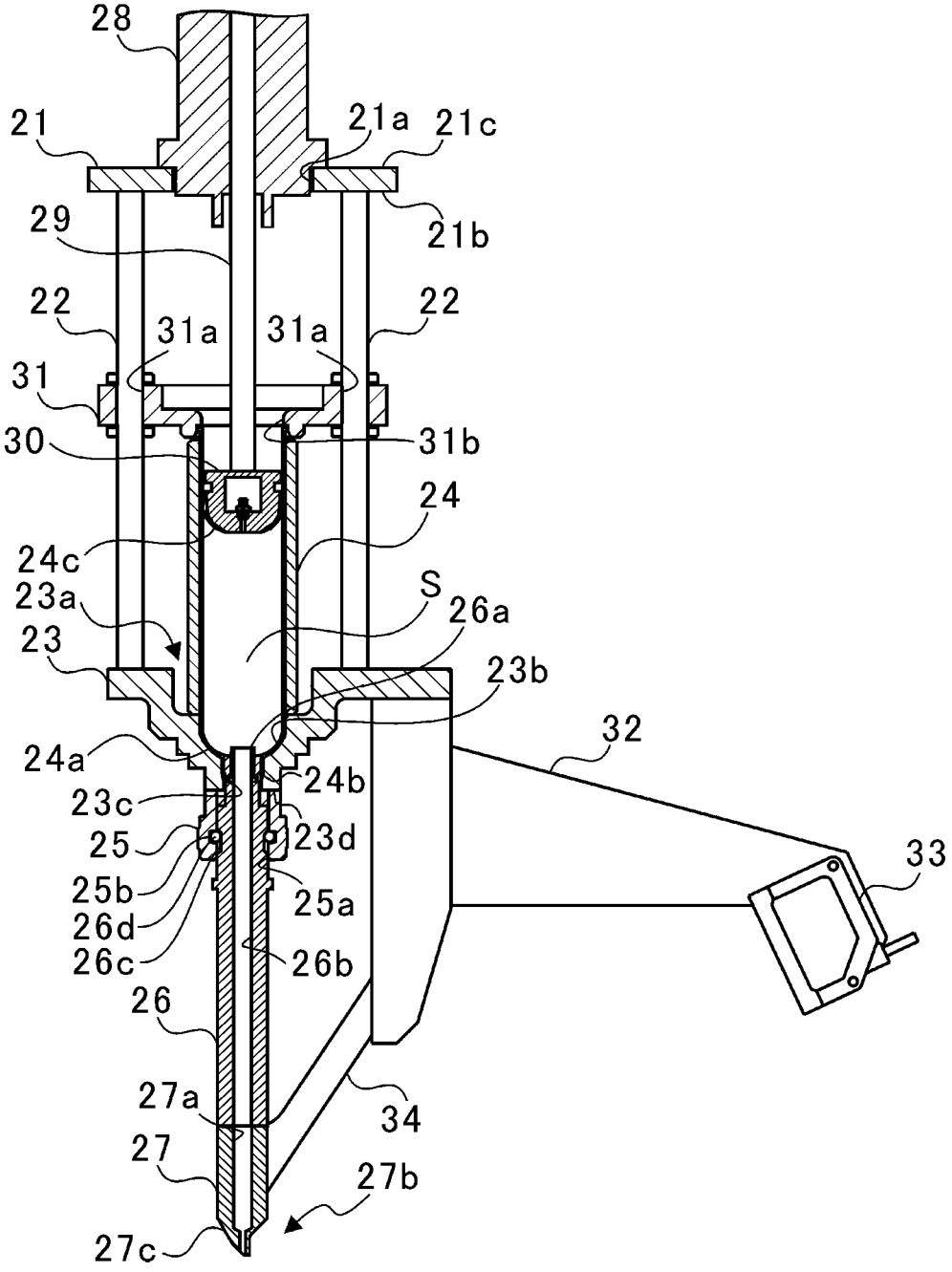
FIG. 3 is a partial cross-sectional view of the sealing gun.

FIG. 2 is a view illustrating the configuration of the sealing gun 2. FIG. 3 is a partial cross-sectional view of the sealing gun 2. It is to be noted that laser emitted from a measuring instrument 33 is illustrated by a dashed-dotted line. In FIG. 3, hatching is applied to each portion indicated by a cross section.

As illustrated in FIGS. 2 and 3, the sealing gun 2 includes a support plate 21, rails 22, a cartridge receiver 23, a cartridge 24, a nozzle chuck 25, a nozzle adapter 26, a nozzle 27, an actuator 28, a rod 29, a pusher 30, and a pressure plate 31.

Hereinafter a description will be given where the direction (the direction in which the nozzle adapter 26, the nozzle 27 are extended) in which the pusher 30 is moved is a sliding direction. A description will be given where in the sliding direction, the direction (the direction from the actuator 28 toward the nozzle 27) in which the pusher 30 is pushed-in is referred to as a tip end direction, the direction (the direction from the nozzle 27 toward the actuator 28) in which the pusher 30 is pulled back is referred to as a terminal end direction.

The support plate 21 is formed in a plate shape extending in a direction perpendicular to the sliding direction. A through hole 21*a* penetrating in the sliding direction is formed in the center of the support plate 21. The support plate 21 is supported at the tip end of the robot arm 3. In other words, the sealing gun 2 is supported by the robot arm 3 via the support plate 21.

Two rails 22 are fixed to the lower surface 21*b* of the support plate 21. The two rails 22 are provided at symmetric positions across the through hole 21*a* on the support plate 21, and extend in the sliding direction.

In the two rails 22, the cartridge receiver 23 is fixed to each end thereof in the sliding direction. A through hole 23*a* penetrating in the sliding direction is formed in the center of the cartridge receiver 23. The cartridge 24 is inserted in the through hole 23*a* from the side of the support plate 21.

The cartridge 24 is formed in a circular cylindrical shape, and a tip end 24*a* is formed in a hemisphere shape. In addition, a projection member 24*b* projecting in a circular cylindrical shape is formed at the center of the tip end 24*a*.

The sealant S is stored inside the cartridge 24. A plunger 24*c* is movably provided in the cartridge 24 in the sliding direction. The sealant S is sealed in the cartridge 24 along with the plunger 24*c*. The sealant S is, for example, two-liquid mixing sealant which is cured by mixing two different liquid. In the present embodiment, when the sealant S stored in the cartridge 24 is used up, the whole cartridge 24 is designed to be replaced in the sealing gun 2. A general-purpose cartridge is used as the cartridge 24.

The through hole 23*a* of the cartridge receiver 23 includes a cartridge receive groove 23*b* which is dented in a hemisphere shape in conformity with the shape of the tip end 24*a* of the cartridge 24. A first tapered member 23*c* is formed in the tip end direction at the center of the cartridge receive groove 23*b*. The shape of the through hole 23*a* will be described in detail later.

The nozzle chuck 25 is fixed to a lower surface 23*d* of the cartridge receiver 23. The nozzle chuck 25 includes a through hole 25*a* penetrating in the sliding direction. The axial center of the through hole 25*a* is positioned concentrically with the axial center of the through hole 23*a* of the cartridge receiver 23. The nozzle adapter 26 is inserted in the through hole 25*a* of the nozzle chuck 25.

The nozzle adapter 26 is formed in a circular cylindrical shape. A terminal end 26*a* of the nozzle adapter 26 in the terminal end direction is inserted in the projection member 24*b* of the cartridge 24. The nozzle adapter 26 includes a through hole 26*b* penetrating in the sliding direction. The through hole 26*b* communicates with the internal space of the cartridge 24. The shape of the terminal end 26*a* will be described in detail later.

Multiple ball grooves 25*b* are formed in the inner wall surface of the through hole 25*a* of the nozzle chuck 25. Ball grooves 26*c* are formed on the outer circumferential surface of the nozzle adapter 26 at the positions opposed to the ball grooves 25*b* of the nozzle chuck 25. The grooves 26*c* are formed longer than the ball grooves 25*b* in the sliding direction. Balls 26*d* are disposed between the ball grooves 25*b* and the ball grooves 26*c*. The nozzle adapter 26 is movably supported by the nozzle chuck 25 in the sliding direction via the balls 26*d*.

The end of the nozzle adapter 26 in the tip end direction is connected with the nozzle 27. The nozzle 27 includes a through hole 27*a* penetrating in the sliding direction, and is formed in a circular cylindrical shape as a whole. The through hole 27*a* communicates with the through hole 26*b* of the nozzle adapter 26.

The nozzle 27 has a tilted surface 27*c* at a tip end 27*b* in the tip end direction, the tilted surface 27*c* being tilted to the sliding direction. The tip end 27*b* is formed in a V-character shape so that the tip end is notched in two parts.

The actuator 28 is fixed to an upper surface 21*c* of the support plate 21. The actuator 28 is fixed so that its tip end is inserted in the through hole 21*a* of the support plate 21. The rod 29 is movably stored inside the actuator 28 in the sliding direction. The actuator 28 is driven based on the control of the discharge controller 12 and the cartridge replacement controller 14, and causes the rod 29 to move in the sliding direction.

The pusher 30 is mounted on the tip end of the rod 29. The pusher 30 is formed in a hemisphere shape with a diameter smaller than the inner diameter of the cartridge 24. The pusher 30 pushes the plunger 24*c* of the cartridge 24 in the tip end direction along with the movement of the rod 29. Also, space communicating with the tip end side (the plunger 24*c* side) is formed inside the pusher 30. In the pusher 30, the internally formed space is coupled to a vacuum pump which is not illustrated. The pusher 30 is capable of sucking the plunger 24*c* by driving the vacuum pump.

The two rails 22 are inserted in the pressure plate 31. The pressure plate 31 is formed in a plate shape extending in a direction perpendicular to the sliding direction. The pressure plate 31 includes a through hole 31*a* in which the rails 22 are inserted, and is movable along the rails 22. In the pressure plate 31, a through hole 31*b* is formed in the sliding direction, the through hole 31*b* having a diameter larger than the outer diameter of the pusher 30 and smaller than the outer diameter of the cartridge 24.

The pressure plate 31 is controlled for movement by the control device 4 via an actuator (not illustrated), and is moved in the tip end direction, thereby holding the cartridge 24 with the cartridge receiver 23.

In the sealing gun 2 having such a configuration, when the pusher 30 is moved in the tip end direction based on the control of the discharge controller 12, the sealant S stored inside the cartridge 24 is pressed via the plunger 24*c*. Then, the sealant S is discharged, and applied to the object 100 from the tip end 27*b* of the nozzle 27 by a pressing force of the pusher 30 through the through hole 26*b* and the through hole 27*a*.

In addition, the sealing gun 2 is provided with a measuring instrument supporter 32, a measuring instrument 33, and a nozzle supporter 34. The measuring instrument supporter 32 is fixed to the tip end direction side of the cartridge receiver 23. The measuring instrument 33 is fixed to the tip end of the measuring instrument supporter 32.

The measuring instrument 33 is a distance sensor that emits laser as well as receives the emitted laser, thereby making it possible to measure the distance to a position at which the laser is reflected. The measuring instrument 33 emits laser to the tip end 27*b* of the nozzle 27, more specifically, to the sealant S discharged through the nozzle 27.

The measuring instrument 33 is coupled to the control device 4, and outputs a measurement result to the control device 4. The control device 4 (the discharge controller 12, see FIG. 1) can recognize the discharge amount of the sealant S by receiving the distance to the sealant S discharged through the nozzle 27.

The nozzle supporter 34 has one end fixed to the measuring instrument supporter 32 and the other end retaining the nozzle 27. Thus, the nozzle supporter 34 holds the nozzle 27.

Figure 4:
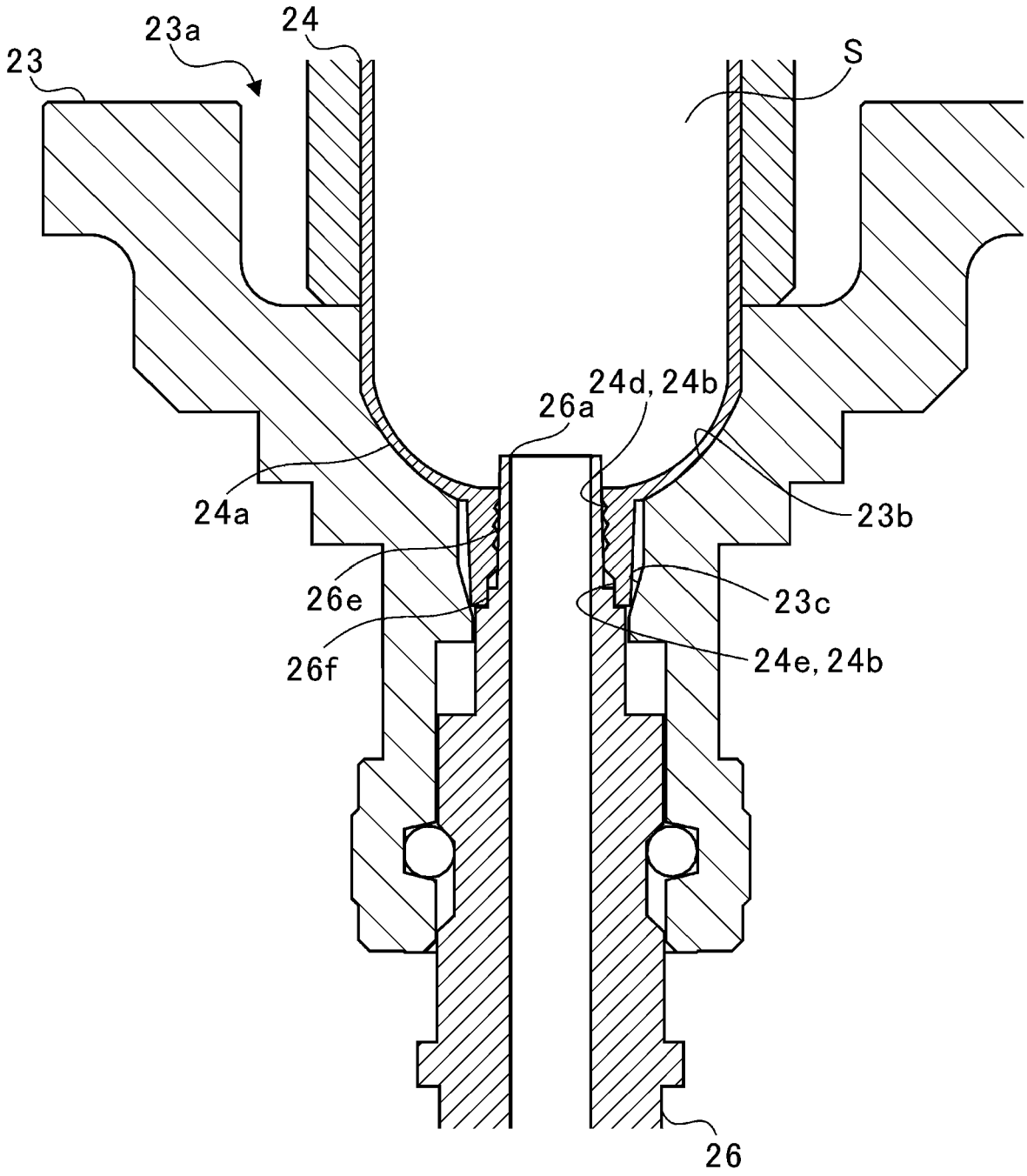
FIG. 4 is a view illustrating the detailed configuration of a cartridge receiver, a cartridge, and a nozzle adapter.

FIG. 4 is a view illustrating the detailed configuration of the cartridge receiver 23, the cartridge 24, and the nozzle adapter 26. In FIG. 4, part of the cartridge receiver 23, the cartridge 24, and the nozzle adapter 26 is illustrated on a large scale.

As illustrated in FIG. 4, the projection member 24*b* of the cartridge 24 is formed in a tapered shape having a gradually decreasing outer diameter toward the tip end in the sliding direction. In the projection member 24*b*, the inside penetrating in the sliding direction is divided into a second tapered member 24*d* and a first large diameter member 24*e*.

The second tapered member 24*d* has a gradually increasing inner diameter toward the tip end in the sliding direction, and a thread groove is formed. The first large diameter member 24*e* is further than the second tapered member 24*d* in the tip end direction, and is formed to be continuous to the second tapered member 24*d*.

The first large diameter member 24*e* is formed to have an inner diameter larger than the inner diameter of the second tapered member 24*d* at the position continuous to the first large diameter member 24*e*. The first large diameter member 24*e* is formed to have the same diameter in the sliding direction.

The terminal end 26*a* of the nozzle adapter 26 is divided into a third tapered member 26*e* and a second large diameter member 26*f*. The third tapered member 26*e* has a gradually decreasing outer diameter in the terminal end direction of the sliding direction. The taper angle of the third tapered member 26*e* is equal or substantially equal to the taper angle of the second tapered member 24*d* of the cartridge 24.

The outer diameter of the most end of the third tapered member 26*e* in the terminal end direction is smaller than the least inner diameter of the second tapered member 24*d*. The outer diameter of the most end of the third tapered member 26*e* in the tip end direction is larger than the greatest inner diameter of the second tapered member 24*d*. Therefore, when the cartridge 24 is inserted in the nozzle adapter 26, the second tapered member 24*d* of the cartridge 24 comes into contact with the third tapered member 26*e* of the nozzle adapter 26. Thus, the cartridge 24 can be easily replaced without screwing down the cartridge 24 in the sealing gun 2. Also, occurrence of leakage of the sealant S between the cartridge 24 and the nozzle adapter 26 when the sealant S is discharged can be reduced without screwing down the cartridge 24.

The second large diameter member 26*f* is formed to have an outer diameter larger than the outer diameter of the third tapered member 26*e* at the position continuous to the second large diameter member 26*f*. In addition, the second large diameter member 26*f* is formed to have an outer diameter equal or substantially equal to the inner diameter of the first tapered member 24*e* of the cartridge 24. The second large diameter member 26*f* is formed to have the same diameter in the sliding direction. Therefore, when the cartridge 24 is inserted in the nozzle adapter 26, the first large diameter member 24*e* of the cartridge 24 comes into contact with the second large diameter member 26*f* of the nozzle adapter 26. Consequently, in the sealing gun 2, occurrence of leakage of the sealant S between the cartridge 24 and the nozzle adapter 26 when the sealant S is discharged can be reduced without screwing down the cartridge 24.

The first tapered member 23*c* of the cartridge receiver 23 has a gradually decreasing inner diameter toward the tip end in the sliding direction. Also, the inner diameter (the greatest inner diameter) of the end of the first tapered member 23*c* in the terminal end direction is larger than the outer diameter of the end of the projection member 24*b* of the cartridge 24 in the tip end direction. The inner diameter (the least inner diameter) of the end of the first tapered member 23*c* in the tip end direction is smaller than the outer diameter of the end of the projection member 24*b* of the cartridge 24 in the tip end direction. Therefore, when the cartridge 24 is inserted in the nozzle adapter 26, the projection member 24*b* of the cartridge 24 comes into contact with the first tapered member 23*c* of the cartridge receiver 23, and a force toward the radially inner side is applied. This causes the first large diameter member 24*e* of the cartridge 24 to press against the second large diameter member 26*f* of the nozzle adapter 26, and thus occurrence of leakage of the sealant S between the cartridge 24 and the nozzle adapter 26 can be further reduced.

Figures 5A, 5B, 5C:
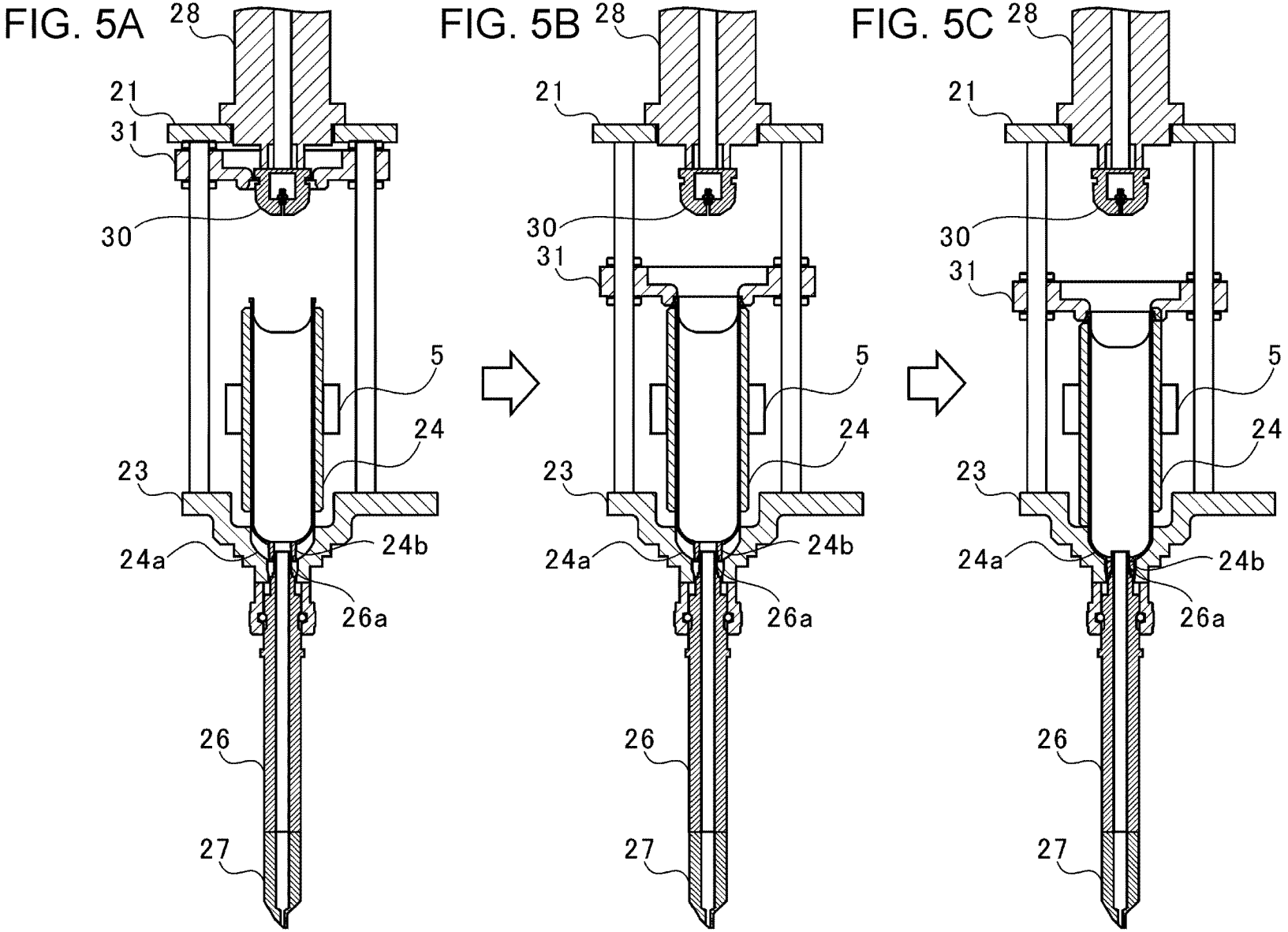
FIGS. 5A to 5C are views illustrating attachment of a cartridge.

Next, attachment and detachment of the cartridge 24 will be described. FIGS. 5A to 5C are views illustrating the attachment of the cartridge 24. As described above, the cartridge 24 is attached to the sealing gun 2 based on the control of the cartridge replacement controller 14 (see FIG. 1).

Specifically, as illustrated in FIG. 5A, the cartridge replacement controller 14 holds the cartridge 24 by the robot hand 5. The cartridge replacement controller 14 controls the robot hand 5, and inserts the projection member 24*b* of the cartridge 24 into the terminal end 26*a* of the nozzle adapter 26. Here, only part of the projection member 24*b* of the cartridge 24 is inserted into the terminal end 26*a* of the nozzle adapter 26.

Subsequently, as illustrated in FIG. 5B, the cartridge replacement controller 14 reduces the holding power of the robot hand 5, and moves the pressure plate 31 in the tip end direction. At this point, due to the reduced holding power, the cartridge 24 is moved so as to slide against the robot hand 5. As illustrated in FIG. 5C, the cartridge 24 is inserted into the nozzle adapter 26 by the pressing force of the pressure plate 31.

Subsequently, the cartridge replacement controller 14 removes the robot hand 5 from the cartridge 24, and completes the attachment of the cartridge 24.

FIGS. 6A to 6D are views illustrating the detachment of the cartridge 24. As described above, the cartridge 24 is detached from the sealing gun 2 based on the control of the cartridge replacement controller 14.

Figure 6A:
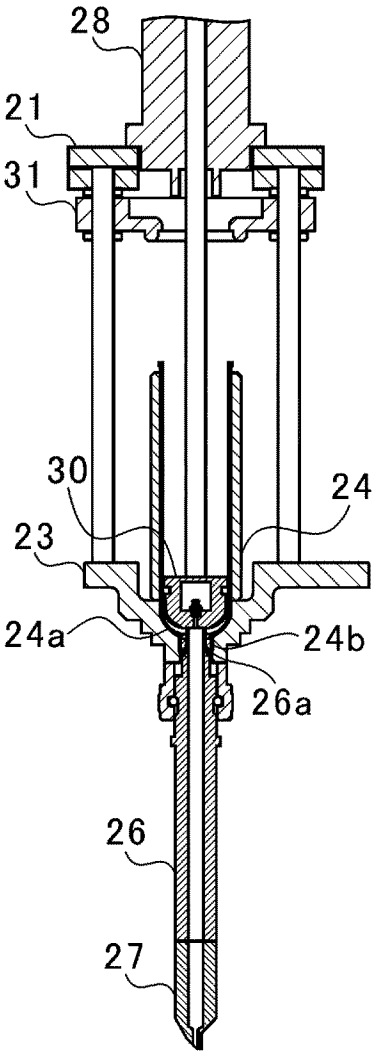
FIGS. 6A to 6D are views illustrating detachment of a cartridge.
Figure 6B:
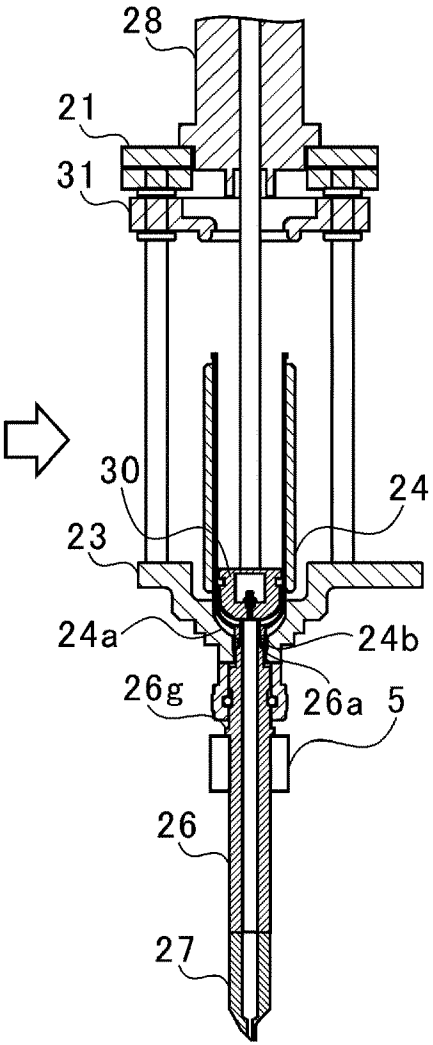

Specifically, as illustrated in FIG. 6A, the cartridge replacement controller 14 first moves the pressure plate 31 in the terminal end direction. As illustrated in FIG. 6B, the cartridge replacement controller 14 hooks the robot hand 5 on a projection member 26*g* of the nozzle adapter 26, and moves the robot hand 5 in the terminal end direction. Then the cartridge 24 is moved in the terminal end direction along with the nozzle adapter 26, and is separated from the cartridge receiver 23. In this stage, the cartridge 24 is still fitted in the nozzle adapter 26.

Figure 6C:
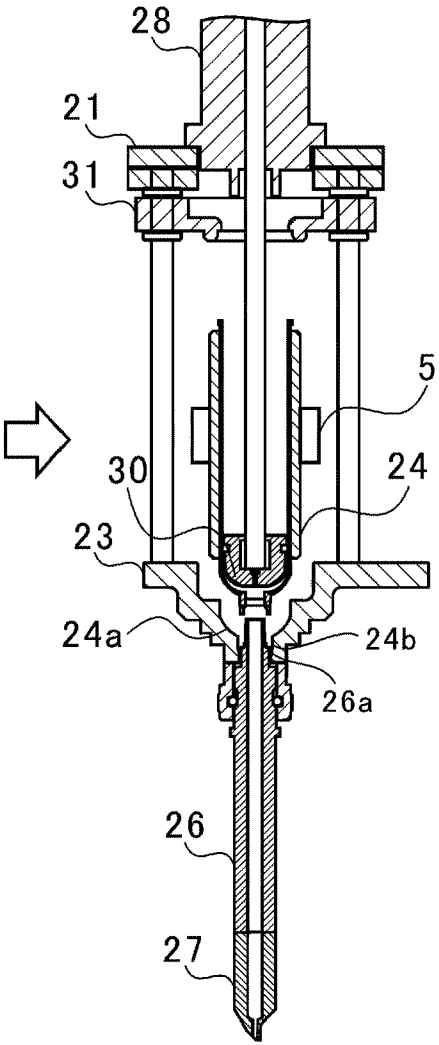

Subsequently, as illustrated in FIG. 6C, the cartridge replacement controller 14 causes the robot hand 5 to hold the cartridge 24. The cartridge replacement controller 14 then drives the vacuum pump coupled to the internal space of the plunger 24*c*, then drives the actuator 28 to move the pusher 30 in the terminal end direction. Consequently, the cartridge 24 is detached from the nozzle adapter 26.

Figure 6D:
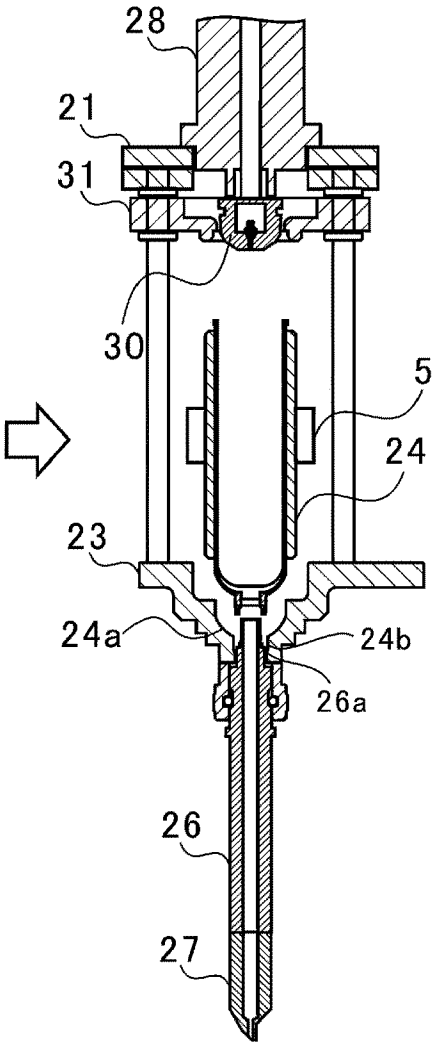

Subsequently, as illustrated in FIG. 6D, the cartridge replacement controller 14 stops the vacuum pump, drives the actuator 28 to further move the pusher 30 in the terminal end direction, and completes the detachment of the cartridge 24.

Although a preferred embodiment of the disclosure has been described above with reference to the accompanying drawings, it is needless to state that the disclosure is not limited to the preferred embodiment. It is apparent that various modifications and alterations will occur to those skilled in the art within the scope of the appended claims, and it is be understood that those modifications and alterations naturally fall within the technical scope of the disclosure.

In the aforementioned embodiment, the case has been described where the nozzle adapter 26 and the nozzle 27 are separately provided. However, the nozzle adapter 26 and the nozzle 27 may be permanently affixed as a nozzle member.

According to the disclosure, replacement of a cartridge is made easy.

The invention claimed is:

1. A sealant discharging apparatus comprising:

a cartridge comprising a projection member at a tip end and storing therein sealant, the projection member having a thread groove internally;

a nozzle member comprising a terminal end insertable in the projection member; and a cartridge receiver comprising a first tapered member in which the projection member is insertable, the first tapered member having a gradually decreasing inner diameter in a tip end direction in which the projection member is insertable, wherein a largest inner diameter of the first tapered member is larger than an outer diameter of the tip end of the projection member, and a smallest inner diameter of the first tapered member is smaller than the outer diameter of the tip end of the projection member.

2. The sealant discharging apparatus according to claim 1, wherein the projection member comprises:

a second tapered member having a gradually increasing inner diameter in the tip end direction, and a first large diameter member that is located further than the second tapered member in the tip end direction, and continuous to the second tapered member; and the nozzle member comprises:

a third tapered member having a gradually increasing outer diameter in the tip end direction, and a second large diameter member that is located further than the third tapered member in the tip end direction, and continuous to the third tapered member.

3. The sealant discharging apparatus according to claim 2, further comprising a nozzle chuck that movably holds the nozzle member.

4. The sealant discharging apparatus according to claim 1, further comprising a nozzle chuck that movably holds the nozzle member.

5. The sealant discharging apparatus according to claim 1, further comprising a nozzle chuck that movably holds the nozzle member.

6. The sealant discharging apparatus according to claim 1, further comprising a nozzle chuck that movably holds the nozzle member.

7. A sealant discharging apparatus comprising:

a cartridge comprising a projection member at a tip end and storing therein sealant, the projection member having a thread groove internally;

a nozzle member comprising a terminal end insertable in the projection member; and a cartridge receiver comprising a first tapered member in which the projection member is insertable, the first tapered member having a gradually decreasing inner diameter in a tip end direction in which the projection member is insertable, wherein the projection member comprises:

a second tapered member having a gradually increasing inner diameter in the tip end direction, and a first large diameter member that is located further than the second tapered member in the tip end direction, and continuous to the second tapered member; and the nozzle member comprises:

a third tapered member having a gradually increasing outer diameter in the tip end direction, and a second large diameter member that is located further than the third tapered member in the tip end direction, and continuous to the third tapered member.

* * * * *